US007515843B2

(12) United States Patent
Bonino et al.

(10) Patent No.: US 7,515,843 B2
(45) Date of Patent: Apr. 7, 2009

(54) COLOR MIS-REGISTRATION MEASUREMENT USING AN INFRA-RED COLOR DENSITY SENSOR

(75) Inventors: Paul S. Bonino, Ontario, NY (US); Ralph A. Shoemaker, Rochester, NY (US); Michael J. Martin, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 255 days.

(21) Appl. No.: 11/274,523

(22) Filed: Nov. 15, 2005

(65) Prior Publication Data

US 2007/0110465 A1 May 17, 2007

(51) Int. Cl.
*G03G 15/00* (2006.01)

(52) U.S. Cl. ..... 399/49

(58) Field of Classification Search ..... 399/49, 399/301

See application file for complete search history.

(56) References Cited

U.S. PATENT DOCUMENTS

| | | | | |
|---|---|---|---|---|
| 4,553,033 | A | 11/1985 | Hubble, III et al. | |
| 5,394,223 | A | 2/1995 | Hart et al. | |
| 5,519,497 | A | 5/1996 | Hubble, III et al. | |
| 5,537,190 | A | 7/1996 | Folkins et al. | |
| 5,839,016 | A | 11/1998 | Folkins et al. | |
| 5,909,235 | A | 6/1999 | Folkins | |
| 6,275,244 | B1 | 8/2001 | Omelchenko et al. | |
| 6,493,083 | B2 * | 12/2002 | Parisi et al. | 356/399 |
| 6,608,643 | B2 | 8/2003 | Lofthus et al. | |
| 2003/0053093 | A1 * | 3/2003 | Eom | 358/1.9 |
| 2004/0227966 | A1 * | 11/2004 | Lee | 358/1.9 |
| 2005/0104950 | A1 * | 5/2005 | Eom | 347/116 |
| 2006/0056882 | A1 * | 3/2006 | Kwon et al. | 399/301 |

FOREIGN PATENT DOCUMENTS

| | | | |
|---|---|---|---|
| JP | 01179955 | A * | 7/1989 |
| JP | 01207764 | A * | 8/1989 |
| JP | 2001154425 | A * | 6/2001 |
| JP | 2002131997 | A * | 5/2002 |
| JP | 2004069805 | A * | 3/2004 |
| JP | 2004125827 | A * | 4/2004 |
| JP | 2006025359 | A * | 1/2006 |

* cited by examiner

*Primary Examiner*—Quana M Grainger
(74) *Attorney, Agent, or Firm*—Fay Sharpe LLP

(57) ABSTRACT

A xerographic system (8) includes a moving photoreceptor (10) and multiple toner development systems (12, 14) arranged to selectively dispose regions of toner on the moving photoreceptor. A toner density sensor (40) is arranged to measure toner density on the moving photoreceptor over a sensor area (A). A toner coverage monitor (64) operatively connected with the toner density sensor (40) monitors toner coverage based on measurements by the toner density sensor of toner coverage calibration regions disposed on the moving photoreceptor by the multiple toner development systems. A spatial registration monitor (66) also operatively connected with the toner density sensor (40) monitors spatial registration of the multiple toner development systems based on measurements by the toner density sensor of spatial registration calibration regions disposed on the moving photoreceptor by the multiple toner development systems.

16 Claims, 11 Drawing Sheets

COLOR MIS-REGISTRATION MEASUREMENT USING AN INFRA-RED COLOR DENSITY SENSOR

BACKGROUND

The following relates to the printing arts. It finds particular application in spatial alignment of highlight and black toner development systems in black xerographic printing with highlighting, and is described with particular reference thereto. The following finds more general application in spatial alignment of xerographic marks produced by different toner development systems such as are used in full color xerographic printing, two-tone xerographic printing, and so forth.

In xerographic printing employing a single toner development system, a moving photoreceptor belt passes through a charging station where it is electrostatically charged. The electrostatically charged belt then passes through an imaging station where an electrostatic image is formed on a portion of the belt by selectively discharging regions of the photoreceptor belt to form a latent image. The selective discharging is typically performed by selective exposure to visible, infrared, ultraviolet, or other light, although other spatially selective electrostatic discharge systems can be used. The electrostatic latent image is developed at a developing station where toner material selectively coats the latent image based upon the local electrostatic charge, thus forming a toner image corresponding to the latent image. At a transfer station, the toner image is transferred by contact to paper or another print medium. After leaving the transfer station, the belt portion containing the toner image passes through a cleaning station that removes residual toner to erase the toner image, and the belt portion then passes back into the charging station to begin processing for another page. The paper or other print medium, after leaving the transfer station, passes through a fuser which applies pressure and heat to fuse the toner to produce the final image on the paper or other print medium.

Some types of xerographic printing systems include multiple toner development systems. For example, full color CMYK xerographic printing systems typically include cyan (C), magenta (M), yellow (Y), and black (K) toner development systems. As another example, a black printing system may provide a primary black (K) toner development system and also a highlighting color (e.g., red) toner development system for providing selected highlighted marks distinct from the general black coverage.

When multiple toner development systems are employed, each toner development system typically includes its own charging station, imaging station, and development station. The moving photoreceptor belt successively passes through the multiple toner development systems to acquire a combined toner image including multiple superimposed toner images produced by the multiple toner development systems. The combined toner image passes through a transfer station to be transferred to the paper or other print medium, then through a cleaning station to remove residual toner, and back to the starting toner development system to begin processing for another page.

For good image quality, the marks produced by the different toner development systems should be accurately relatively spatially registered on the photoreceptor belt. That is, the superimposed toner images from the multiple toner development systems should be accurately aligned with each other.

Heretofore, registration of the superimposed toner images has been performed in various ways. In a manual approach, calibration sheets are printed with, for example, neighboring black regions and highlight color regions. The spacing of these printed regions on the calibration sheets is compared with the intended spacing, and adjustments are made at one or more of the imaging stations. Additional calibration sheets are printed and manually re-measured, and this process is repeated until the spacing of the black and highlight regions on the calibration sheets matches the intended spacing. Such manual approaches are time-consuming, waste paper or other print media, and are not amenable to rapid periodic registration calibration during printing. Moreover, intervening processes such as toner spreading during the fusing can limit the accuracy of the manual spacing measurements used for the manual registration process.

Another approach is the so-called "marks-on-belt" or MOB process. In this approach, a toner development system to be aligned generates slanted-bar or chevron toner marks on the photoreceptor belt. A dedicated MOB sensor detects the toner marks, and based on timing differences between the sensing of toner marks produced by different toner development systems, registration or alignment of the multiple toner development systems is achieved. The MOB process has the advantages of being automated and amenable to rapid periodic registration calibration during printing. The dedicated MOB sensor and timing-based alignment process substantially increases printing system cost and complexity.

Another approach is disclosed in Parisi et al., U.S. Pat. No. 6,493,083. In this approach, a dedicated optical sensor measures test pattern areas to detect toner development system misalignments. This approach again involves a dedicated sensor, thus increasing printing system cost and complexity.

INCORPORATION BY REFERENCE

The following patents: U.S. Pat. No. 5,519,497 issued May 21, 1996 to Hubble III et al.; and U.S. Pat. No. 4,553,033 issued Nov. 12, 1985 to Hubble III et al., are each incorporated by reference herein in its entirety.

BRIEF DESCRIPTION

In some embodiments, a xerographic printing method includes performing xerographic printing using a photoreceptor and multiple toner development systems. Density of toner coverage on the photoreceptor provided by the multiple toner development systems is calibrated using a toner density sensor, and spatial registration of the multiple toner development systems is performed using the toner density sensor.

In some embodiments, a xerographic printing method includes xerographic printing performed using a moving photoreceptor and multiple toner development systems. A pattern of toner-coated regions is formed on the moving photoreceptor using two or more toner development systems of the multiple toner development systems. The pattern includes alternating toner coated regions each large enough to substantially fill the sensor area of the toner density sensor. The toner coated regions alternate along a direction of photoreceptor movement. The pattern of toner-coated regions is measured using a toner density sensor as the moving photoreceptor moves the pattern of toner-coated regions through a sensor area of the toner density sensor. The misregistration is determined based on a time varying signal of the toner density sensor produced as the photoreceptor movement transitions the measuring across the alternating toner-coated regions.

In some embodiments, a xerographic system includes a moving photoreceptor and multiple toner development systems arranged to selectively dispose regions of toner on the moving photoreceptor. A toner density sensor is arranged to measure toner density on the moving photoreceptor over a sensor area. A toner coverage monitor operatively connected with the toner density sensor monitors toner coverage based on measurements by the toner density sensor of toner coverage calibration regions disposed on the moving photoreceptor by the multiple toner development systems. A spatial registration monitor also operatively connected with the toner density sensor monitors spatial registration of the multiple toner development systems based on measurements by the toner density sensor of spatial registration calibration regions disposed on the moving photoreceptor by the multiple toner development systems.

BRIEF DESCRIPTION OF THE DRAWINGS

FIG. 3A shows the pattern with close registration. FIGS. 3B and 3C show the pattern with misregistration in two opposing directions.

FIG. 4A shows the pattern with close registration. FIGS. 4B and 4C show the pattern with misregistrations of 50% and 100% of the pattern toner line width, respectively.

FIG. 6A shows the pattern with close registration. FIGS. 6B and 6C show the pattern with misregistration in two opposing directions.

FIG. 7A shows the pattern with close registration. FIGS. 7B and 7C show the pattern with misregistrations of 50% and 100% of the pattern toner line width, respectively.

DETAILED DESCRIPTION

Figure 1:
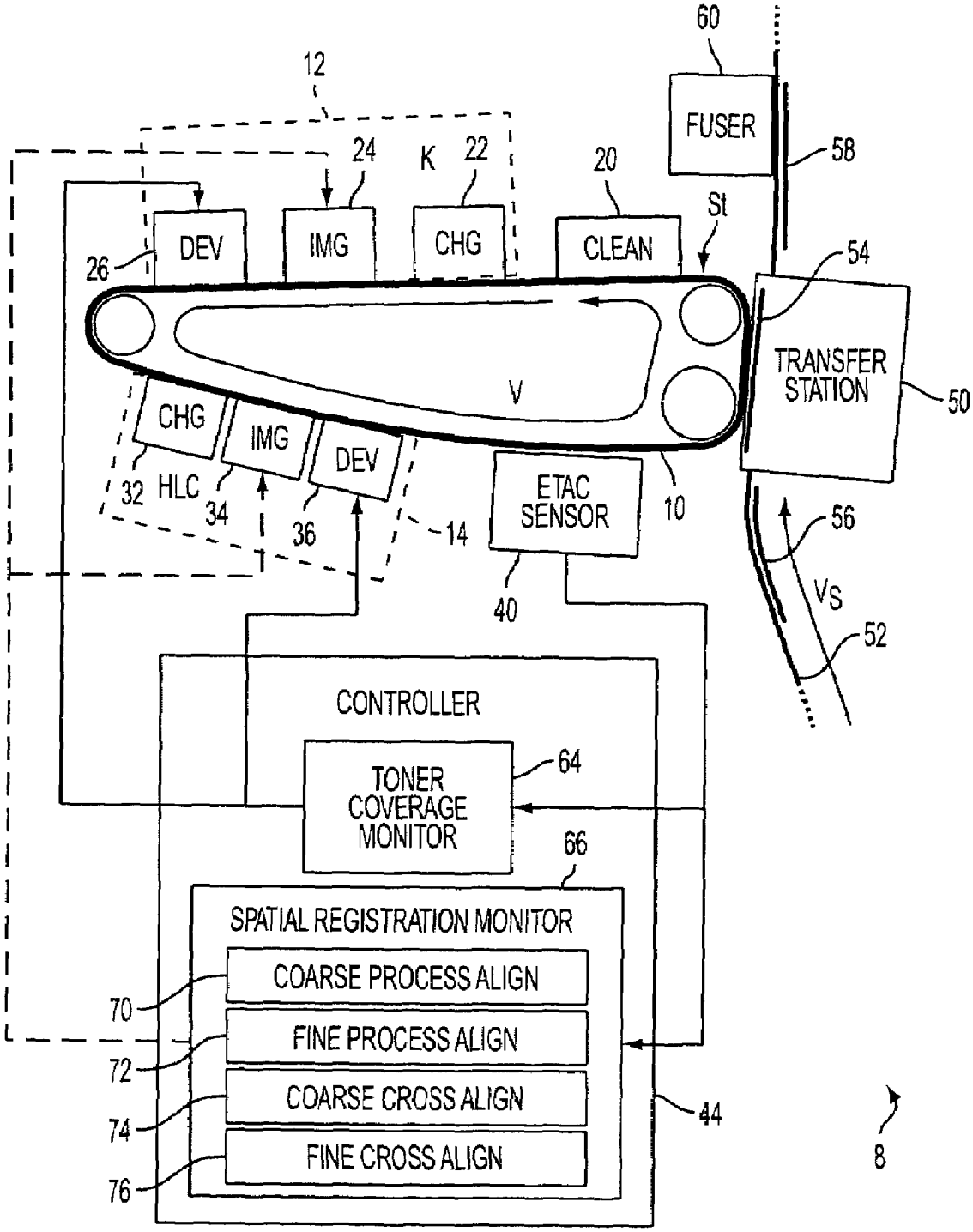
FIG. 1 diagrammatically shows a black printing system with highlighting color, including a controller using a toner density sensor for calibrating toner coverage and for spatially registering the multiple toner development systems.

With reference to FIG. 1, a xerographic printing system 8 includes a photoreceptor in the form of a moving photoreceptor belt 10 driven by gears, pulleys, or so forth in a direction v that is counterclockwise in the viewing direction of FIG. 1. The illustrated example xerographic printing system 8 includes two toner development systems: a main black (K) toner development system 12, and a secondary highlighting color (HLC) toner development system 14. While the example printing system includes two toner development systems 12, 14, it is to be appreciated that the spatial registration and toner coverage measurement and calibration techniques described herein are readily applied to printing systems with three, four, or more toner development systems. For example, the spatial registration and toner coverage measurement and calibration techniques described herein are readily applied to CMYK color printers having four toner development systems. Moreover, the example photoreceptor 10 can be modified in various ways. For example, the photoreceptive surface could be on the inside of the belt, rather than on the outside as illustrated.

The continuously moving photoreceptor belt 10 advantageously facilitates reuse of the photoreceptor surface to print multiple pages. Starting at a belt portion labeled St in FIG. 1, the photoreceptor belt 10 moves in the counterclockwise direction v such that the belt portion moves into a cleaning station 20. At the cleaning station 20, residual toner from the last printed image is removed. The cleaned belt portion then moves into the main black (K) toner development system 12. At a charging sub-station 22, the belt portion receives a substantially uniform electrostatic charge. At an imaging sub-station 24, the black image is "written" onto the electrostatically charged belt portion using a rastered laser beam, an array of light emitting diodes (LEDs), or another mechanism for selectively altering the substantially uniform electrostatic charge. The output of the imaging sub-station is an electrostatic or latent black image. At a development sub-station 26, black toner material selectively coats the latent image based upon the local electrostatic charge, thus forming a black toner image corresponding to the black latent image.

The belt portion with the black toner image then moves into the secondary highlighting color (HLC) toner development system 14. At a charging sub-station 32, the belt portion again receives a substantially uniform electrostatic charge. The charging sub-station 32 produces effectively removes any residual electrostatic charge non-uniformity produced by the previous development system 12, such that the belt portion is again substantially uniformly electrostatically charged, albeit with the black toner image already applied. At an imaging sub-station 34, the image is "written" onto the electrostatically charged belt portion using a rastered laser beam, an array of light emitting diodes (LEDs), or another mechanism for selectively altering the substantially uniform electrostatic charge. The output of the imaging sub-station is an electrostatic or latent HLC image. At a development sub-station 36, HLC toner material selectively coats the HLC latent image based upon the local electrostatic charge, thus forming a HLC toner image corresponding to the HLC latent image. The HLC toner image and the black toner image are now both applied to the belt portion, thus defining the final toner image on the belt portion.

The image portion with the toner image then passes across a toner density sensor, which in the illustrated embodiment is an enhanced toner area coverage (ETAC) sensor 40. As will be described, the ETAC sensor 40 is advantageously used in conjunction with a controller 44 to measure and calibrate both toner coverage and relative spatial registration of the toner development systems 12, 14. Typically, these measurement and calibration tasks are performed using dedicated developed toner test patterns. The test patterns can be applied to the moving photoreceptor belt 10 between toner images of sheets being printed, or can be applied in a separate calibration. In some contemplated embodiments, for example, test patterns are applied three times during every four belt revolutions to perform the spatial registration component of the calibration.

The belt portion then moves to a transfer station 50 that receives a sheet of paper or another print medium via a print media conveyor 52. The conveyor 52 moves the sheets in a direction $v_s$ that is upward in the viewing direction of FIG. 1. At the transfer station 50, the toner image is transferred to a sheet 54. In the view shown in FIG. 1, a next sheet 56 is about to enter the transfer station 50, while a previously printed sheet 58 is presently having its transferred toner image fused through application of heat and pressure by a fuser 60. After passing through the transfer station 50, the belt portion returns back through the starting belt position St and back to the cleaning station 20 where the belt portion is cleaned for use in electrostatically printing another sheet.

With continuing reference to FIG. 1, the controller 44 operates in conjunction with the ETAC sensor 40 to measure and calibrate toner coverage and relative spatial registration of the toner development systems 12, 14. Accordingly, the output of the ETAC sensor 40 serves as an input to a toner coverage monitor 64, and also serves as input to a relative spatial registration monitor 66. As will be described, the relative spatial registration monitor 66 includes components for monitoring and calibrating a coarse process alignment 70, a fine process alignment 72, a coarse cross alignment 74, a fine cross alignment 76. The "process" direction corresponds to the direction of photoreceptor movement, that is, the direction of the belt velocity v. The "cross" direction corresponds to the direction transverse to the direction of photoreceptor movement, that is, the direction transverse to the direction of the belt velocity v.

Figure 2:
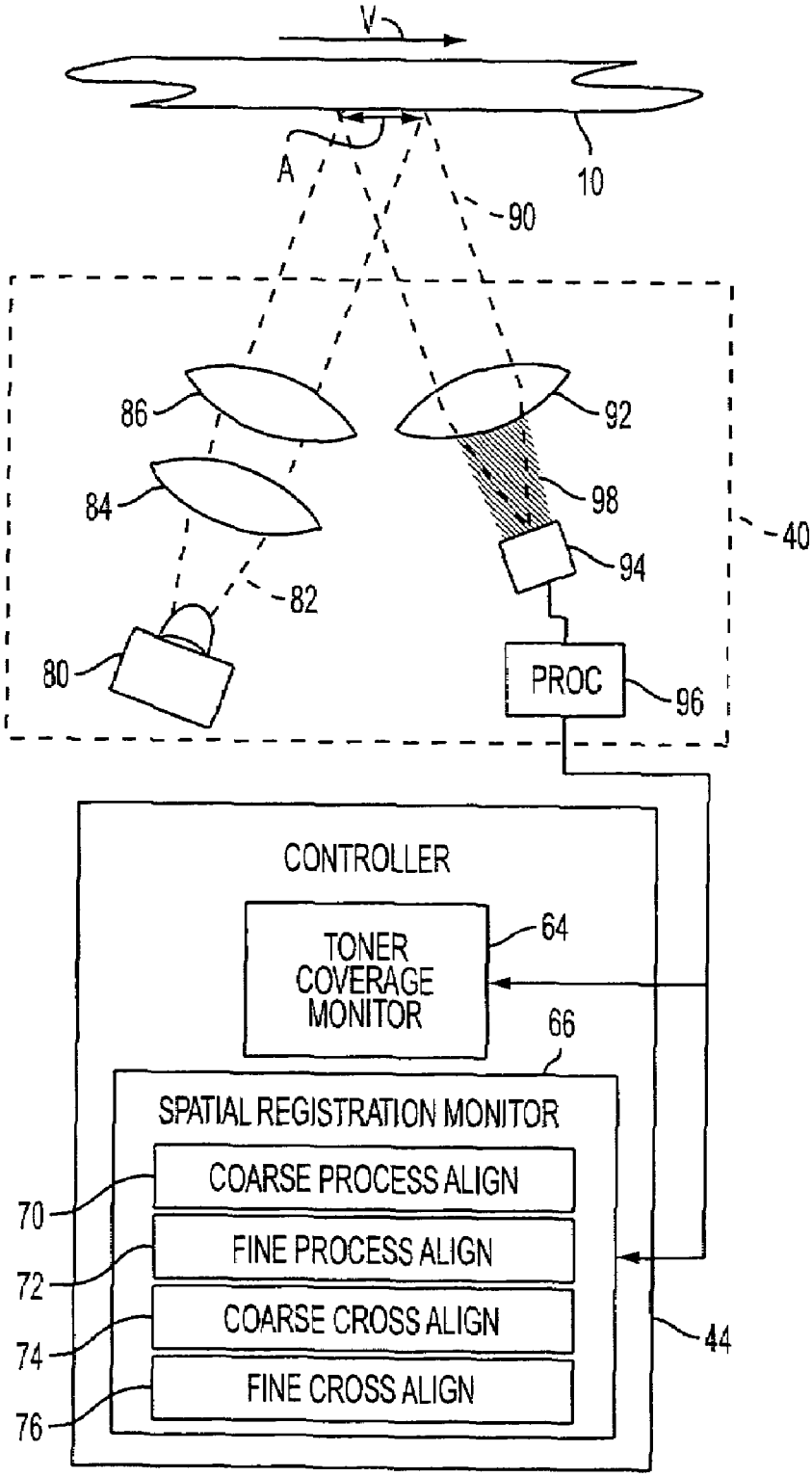
FIG. 2 diagrammatically shows the toner density sensor for calibrating toner coverage and for spatially registering the multiple toner development systems.

With continuing reference to FIG. 1 and with further reference to FIG. 2, the ETAC sensor 40 is illustrated in greater detail. A light source 80 produces light 82 that is focused by one or more optical elements 84, 86 onto a region A of the moving photoreceptor 10 (only a portion of the photoreceptor belt 10 is shown in FIG. 2). The light source 80 can be a laser, light emitting diode (LED), incandescent lamp, or other light source. In some embodiments, the light source 80 is an infrared light source. For example, the light source 80 in some embodiments is a gallium arsenide (GaAs)-based LED or semiconductor laser diode operating at 940 nanometers. The optical elements 84, 86 are typically lenses such as are illustrated; however, other optical elements can be employed in place of or in addition to lenses, such as a collimating parabolic back-reflector, a collimating tube with reflective inner surfaces, or so forth. If the light source produces a sufficiently collimated beam, which may be the case with certain lasers, laser diodes, and LEDs, then the optical elements 84, 86 are optionally omitted.

The incident light 82 reflects off of the photoreceptor belt 10, or off of toner disposed on the photoreceptor belt 10, to generate specularly reflected light 90 that is collected by collection optics 92 and focused onto a photodetector 94. The photodetector 94 measures the intensity of the specularly reflected light 90 to produce a value corresponding to the specular reflectance of the illuminated area A. Optionally, a processing unit 96 performs analog signal processing, digitizing, digital signal processing, or so forth to produce an output of the ETAC sensor 40 having selected characteristics, such as being digital, or being calibrated with respect to reflectance of a calibration standard sample, or so forth. In other embodiments, the processing unit 96 is omitted, and the analog output of the photodetector 94 serves as the output of the ETAC sensor.

The illuminated area A on the moving photoreceptor belt 10 is in some embodiments illuminated with substantially uniform intensity across the area A. In other embodiments, the illuminated area A is illuminated less uniformly, typically with a highest light intensity around the central region of the illuminated area A and with some intensity decrease toward the perimeter of the illuminated area A. In some embodiments, the illuminated area A is substantially uniformly illuminated and has a circular or elliptical perimeter with a diameter of about 3 millimeters. However, the illuminated area A can be otherwise shaped, such as square, rectangular, or so forth, and can have other sizes.

The toner coverage monitor 64 calibrates density of toner coverage on the photoreceptor 10 provided by the multiple toner development systems 12, 14 using the reflectance signal output by the ETAC sensor 40. For example, a dedicated region of toner can be developed on a portion of the photoreceptor belt 10, the reflectance of the dedicated toner region measured using the ETAC sensor 40, and the toner coverage estimated from the measured reflectance. In some embodiments of the ETAC sensor 40, the photodetector 94 is a single photodetector that detects the specularly reflected light 90 that is focused onto the detector. In other embodiments of the ETAC sensor 40, the photodetector 94 includes a photodetector array having a central region or detector that detects the specularly reflected light 90 that is focused onto the center of the detector array, and one or more additional photodetectors that detect diffuse components 98 of the reflected light that flood the detector array. As described for example in U.S. Pat. No. 5,519,497 which is incorporated by reference herein in its entirety, comparison of specular and diffuse reflection components can be used to characterize the toner coverage.

Additionally, the ETAC sensor 40 is used in conjunction with the spatial registration monitor to measure and calibrate relative spatial registration of the black and HLC toner systems. To do so, suitable patterns of interleaved or abutting black and HLC toner are developed on the photoreceptor 10, and characterized using the ETAC sensor 40. The skilled artisan will recognize advantages in reduced cost and printing system complexity in using the same ETAC sensor 40 or other toner density sensor, which is already provided for performing toner coverage monitoring, to additionally perform toner development system spatial registration.

Figure 3A:
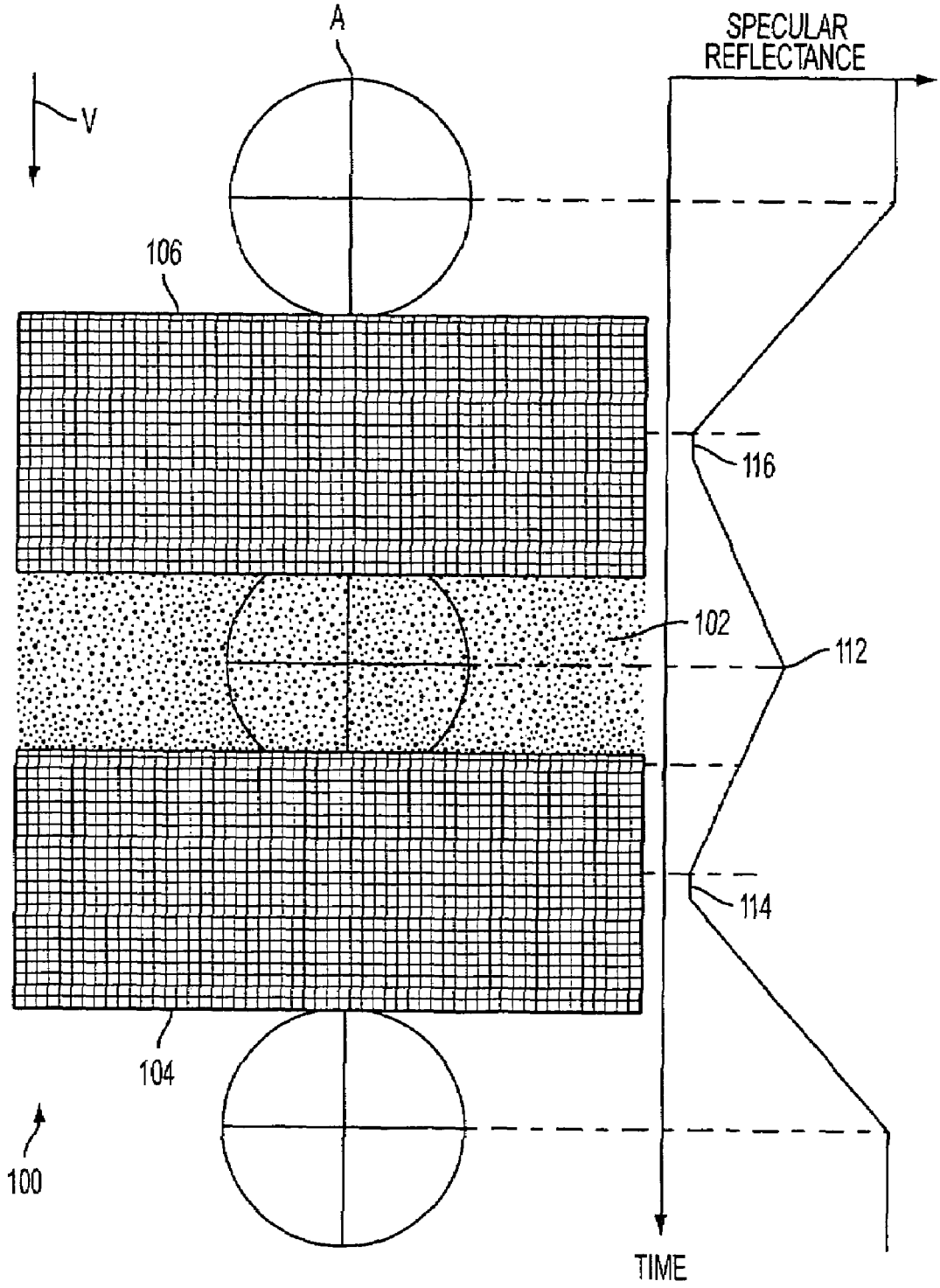
FIGS. 3A, 3B, 3C diagrammatically show a suitable toner pattern for performing the coarse alignment in the process direction.
Figure 3B:
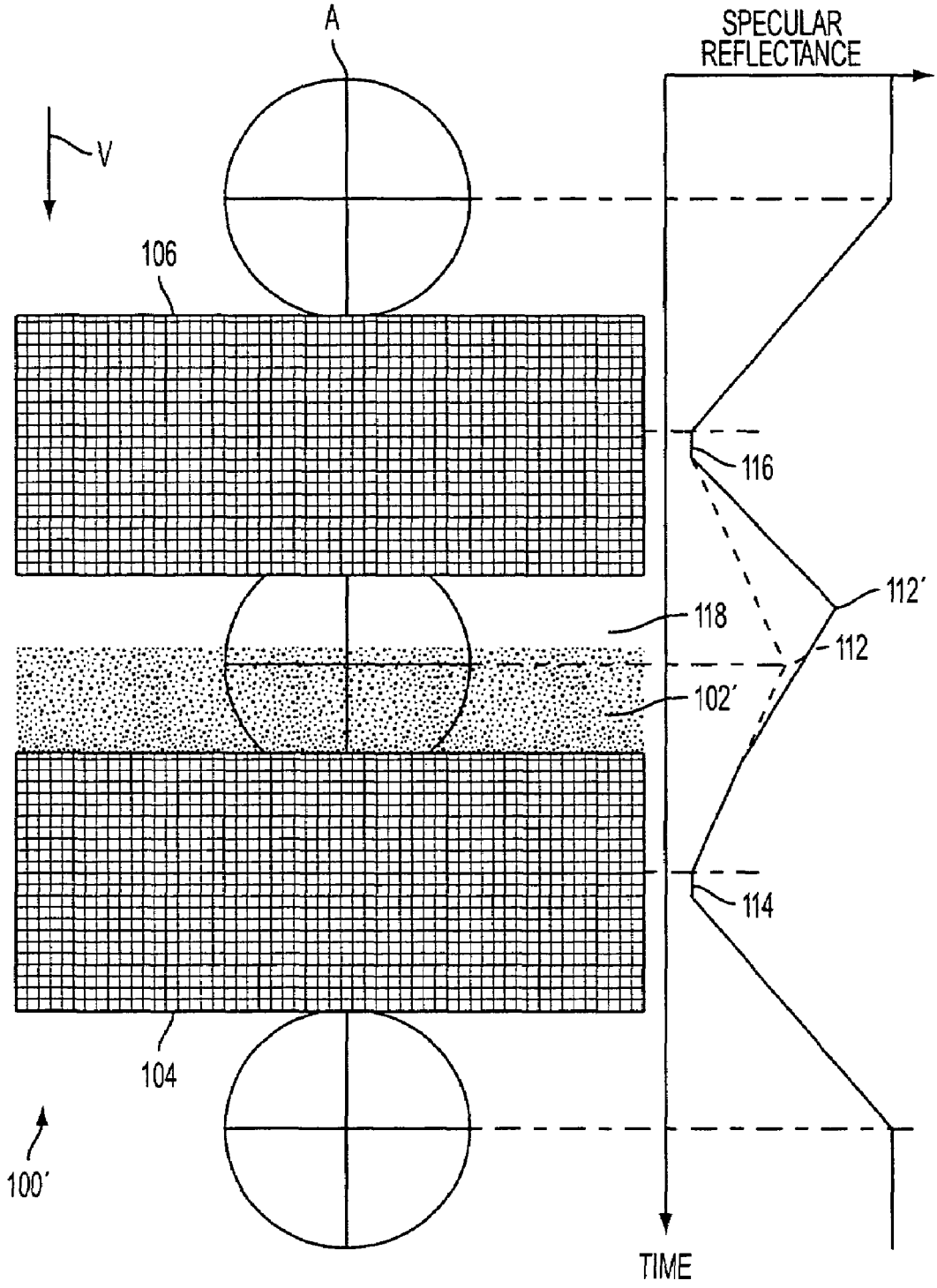
Figure 3C:
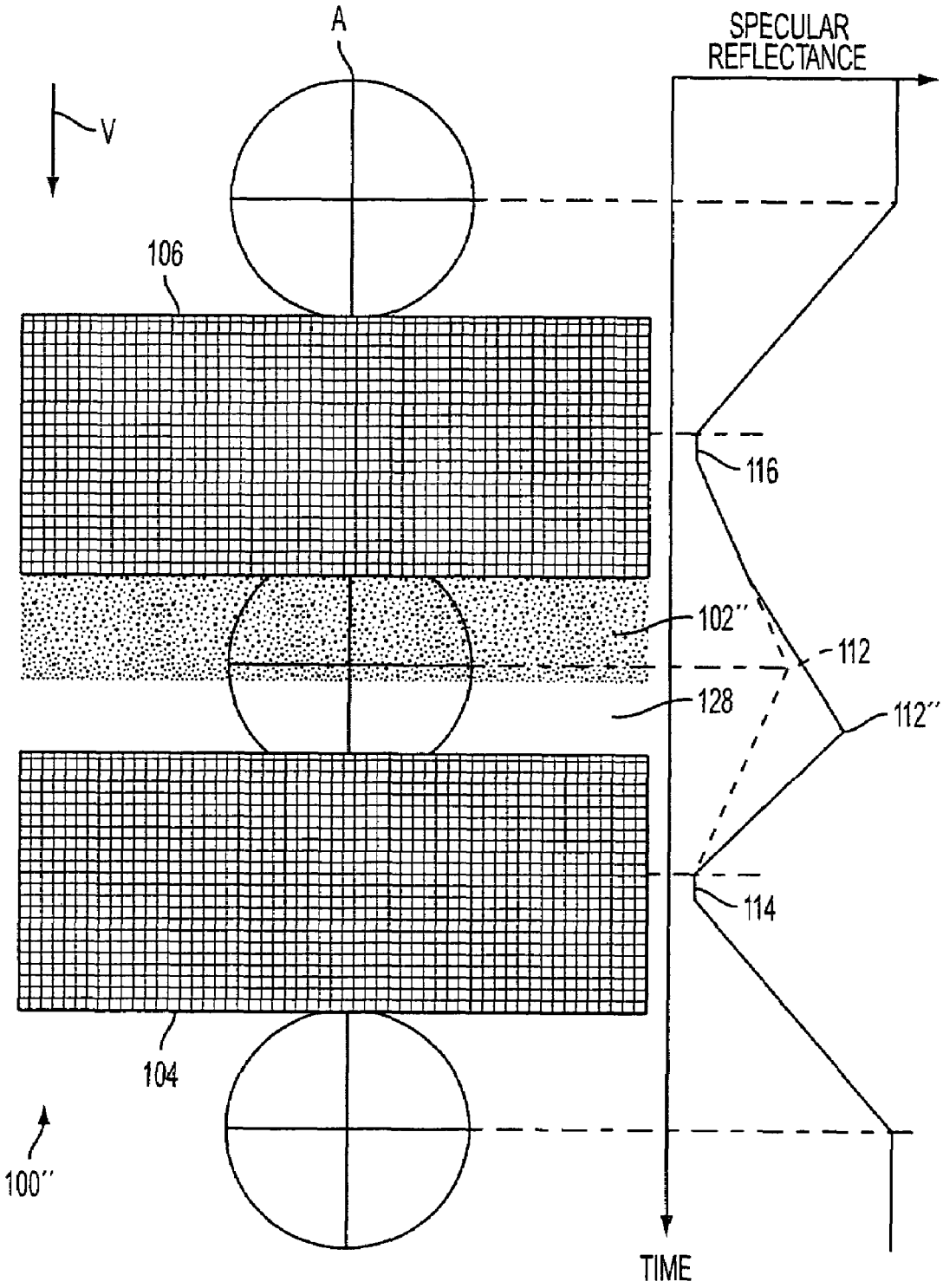

With reference to FIGS. 3A, 3B, and 3C, a coarse process registration is suitably performed using a test pattern 100 that includes a HLC region 102 disposed between black regions 104, 106. The regions 102, 104, 106 are substantially wider than the area A illuminated by the ETAC sensor 40 in the cross direction, that is, transverse to the process direction that is parallel with the belt velocity v. Dimensions of the regions 102, 104, 106 in the process direction that is parallel with the belt velocity v are comparable with the dimension of the illuminated area A in the process direction, so that the illuminated area A resides mostly or completely in a region 102, 104, 106 when the illuminated area A is positioned centered on that region 102, 104, 106.

FIG. 3A shows the case in which there is substantially no coarse process misregistration. In this case, the regions 104, 106 abut the region 102 so that there are no gaps in the test pattern 100. On the right-hand side of FIG. 3A is plotted the specular reflectance as a function of time. Since the belt is moving at the velocity v, the time dimension correlates with position of the illuminated area A on the belt. Several positions of the perimeter of the illuminated area A are shown superimposed on the pattern 100 in FIG. 3A. When the area A is disposed entirely outside of the test pattern 100, the reflectance signal is at its maximum, assuming that the surface of the photoreceptor belt 10 has a higher reflectance than the toner-covered photoreceptor belt surface. When the illumination area A is mostly or completely within one of the black toner areas 104, 106, the reflectance signal is at its minimum, assuming that the black toner has low reflectance. When the illumination area A is mostly or completely within the HLC toner area 102, the reflectance signal is at an intermediate value, assuming that the HLC toner has a reflectance that is intermediate between that of the black toner and the uncoated photoreceptor belt 10. Accordingly, as seen in FIG. 3A the reflectance as a function of time exhibits a maximum value point or interval 112 when the illumination area is centered on the HLC toner area 102, and two minimum value points or intervals 114, 116 when the illumination area is centered on the black toner areas 104, 106, respectively.

FIG. 3B shows a test pattern 100' in which the there is some coarse relative misregistration between the HLC toner area 102' and the abutting black toner areas 104, 106. In FIG. 3B, the misregistration causes the area targeted for HLC toner coverage to partially overlap the black toner area 104. With brief reference back to FIG. 1, in the overlap area the black toner 104 blocks light from the imaging sub-station 34 of the HLC toner development system 14 from reaching the photoreceptor 10; accordingly, the portion of the HLC toner area 102' which would have overlapped the black toner 104 does not get developed. (In some embodiments, HLC toner may overcoat the black toner in the overlap region. The spatial registration calibration techniques described herein are readily applied to such printing systems as well.) Moreover, there is a gap 118 between the black toner region 106 and the HLC toner region 102' due to the misregistration. In the reflectance pattern plotted at the right of FIG. 3B, the misregistration causes the maximum value point or interval 112 (shown in phantom in FIG. 3B) to be shifted to a new, higher maximum reflectance value point or interval 112'. The maximum 112' is higher than the maximum 112 because of the higher reflectance of the bare region 118. In addition to having a higher maximum reflectance, the maximum reflectance value point or interval 112' is temporally shifted in a direction opposite of the misregistration shift of the HLC toner area 102' because of the bare region 118.

FIG. 3C shows a test pattern 100" in which the there is some coarse relative misregistration between the HLC toner area 102" and the abutting black toner areas 104, 106. In FIG. 3C, the misregistration causes the area targeted for HLC toner coverage to partially overlap the black toner area 106, with a gap 128 between the black toner region 104 and the HLC toner region 102" due to the misregistration. In the reflectance pattern plotted at the right of FIG. 3C, the misregistration causes the maximum value point or interval 112 (shown in phantom in FIG. 3C) to be shifted to a new, higher maximum reflectance value point or interval 112" that is higher than the maximum 112 and is temporally shifted in a direction opposite the shift of the maximum 112' of FIG. 3B.

With continuing reference to FIGS. 1, 3A, 3B, and 3C, based on the time-shift of the maximum points 112', 112", the coarse process alignment processor 70 makes a suitable coarse process registration correction applied to one or both imaging sub-stations 24, 34. The correction can be based on a table of corrections versus time-shift of the peak 112', 112". Alternatively, the correction can be a selected percentage of the time shift. Optionally, the amplitude shift of the peak 112', 112" can be used alone or in conjunction with the magnitude of the time shift to determine the magnitude of the spatial toner misregistration. Advantageously, the direction of asymmetry of the reflectance versus time (for example, compare the reflectance plots of FIGS. 3B and 3C) is indicative of the direction of misregistration, and the overall asymmetry is indicative of the magnitude of misregistration.

Figure 4A:
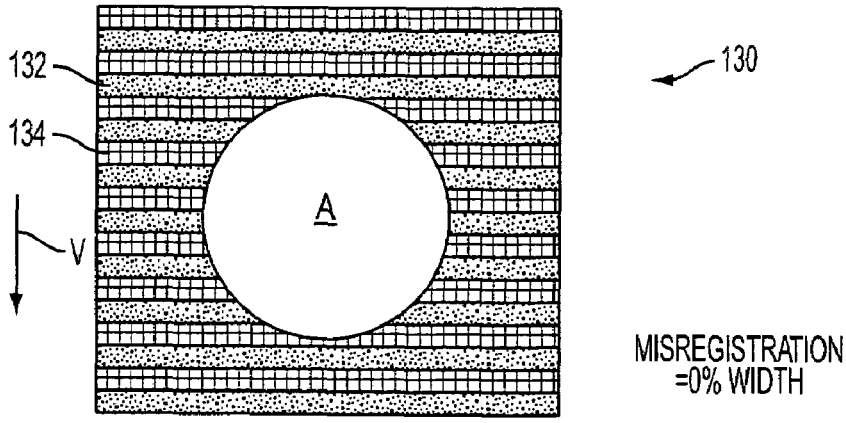
FIGS. 4A, 4B, 4C diagrammatically show a suitable toner pattern for performing the fine alignment in the process direction.
Figure 4B:
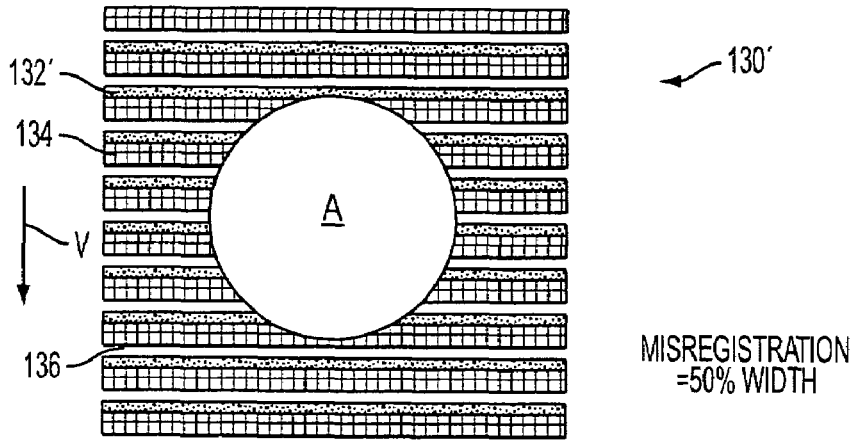
Figure 4C:
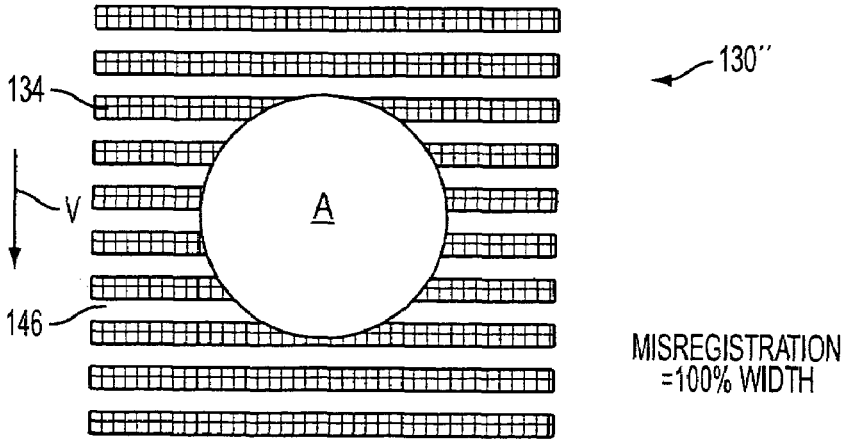

With reference to FIGS. 4A, 4B, and 4C, after the coarse process misregistration is corrected using the test pattern 100, a fine process registration adjustment is optionally performed using a test pattern 130. FIG. 4A shows the test pattern 130 which includes interleaved HLC toner regions 132 and black toner regions 134. The regions 132, 134 are substantially wider than the area A (indicated by a white circular region in FIGS. 4A, 4B, and 4C) illuminated by the ETAC sensor 40 in the cross direction, that is, transverse to the process direction that is parallel with the belt velocity v. Dimensions of the regions 132, 134 in the process direction that is parallel with the belt velocity v are substantially smaller than the dimension of the illuminated area A in the process direction.

FIG. 4A shows the case in which there is substantially no fine process misregistration. In this case, the regions 132, 134 abut so that there are no gaps in the test pattern 130. FIG. 4B shows a corresponding pattern 130' in which there is a fine process misregistration of about 50% of the width of the regions 132, 134 in the process direction. In this case, there are gaps 136 of about one-half the width of the regions 132, 134. Again, since the HLC toner does not develop on top of the previously developed black toner, the regions 132 are replaced by regions 132' that are reduced in width in the process direction by about 50% versus the registered regions 132. FIG. 4C shows a corresponding pattern 130" in which there is a misregistration of about 100% of the width of the regions 132, 134 in the process direction. In this case, there are gaps 146 of about the width of the regions 132, 134. Since the HLC toner completely overlaps the black regions in this case, there is no HLC toner region in the 100% width misregistration case of FIG. 4C.

Figure 5:
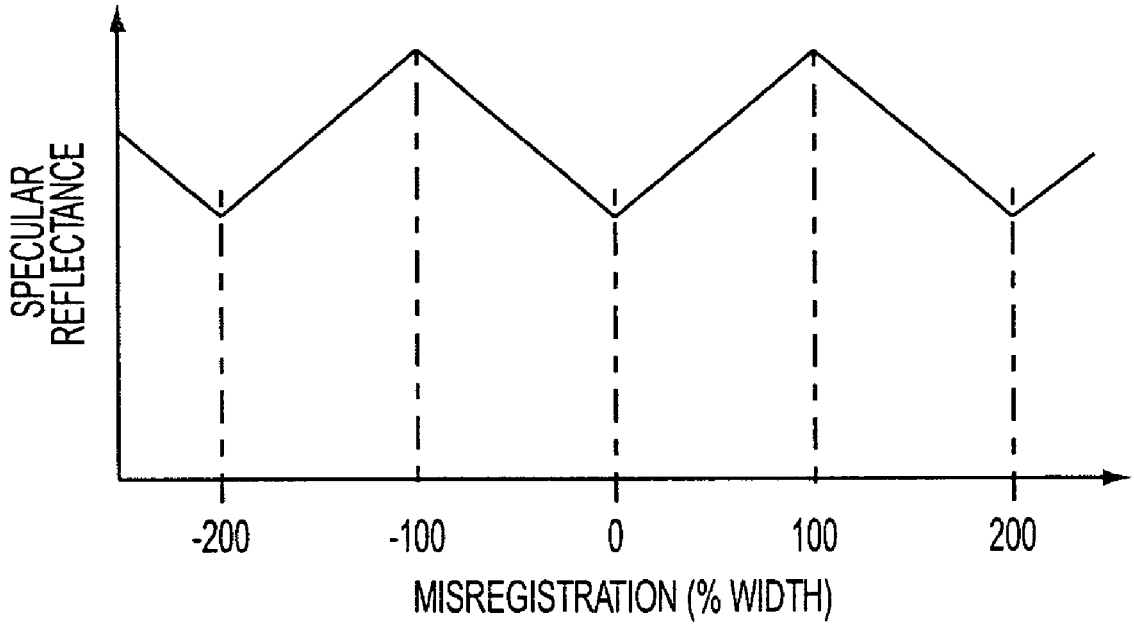
FIG. 5 shows a plot of specular reflectance measured by the toner density sensor for the fine process alignment toner pattern versus misregistration expressed as percentage of the pattern toner line width.

With reference to FIG. 5, the specular reflectance from the pattern 130, 130', 130" is plotted as a function of misregistration as a percentage of the width of the regions 132, 134 in the process direction. It is noted that for misregistrations greater than 100% or less than −100%, the reflectance becomes periodic. Accordingly, the fine process misalignment measurement described with reference to FIGS. 4A, 4B, 4C, and 5 is applicable only for small misalignments of between −100% and 100% of the width of the regions 132, 134 in the process direction. Thus, in most approaches the coarse process registration correction of FIGS. 3A, 3B, and 3C is performed first, followed by the fine process registration of FIGS. 4A, 4B, 4C, and 5. The fine process alignment processor 72 then performs a fine adjustment of one or both imaging sub-stations 24, 34 based on the specular reflectance calibration of FIG. 5. In some approaches, test patterns in which the HLC regions 132 are offset by varying amounts (such as 0% width, 5% width, 10% width, or so forth) are printed and measured, and the offset providing the lowest specular reflectance is selected as the spatially registered setting.

Figure 6A:
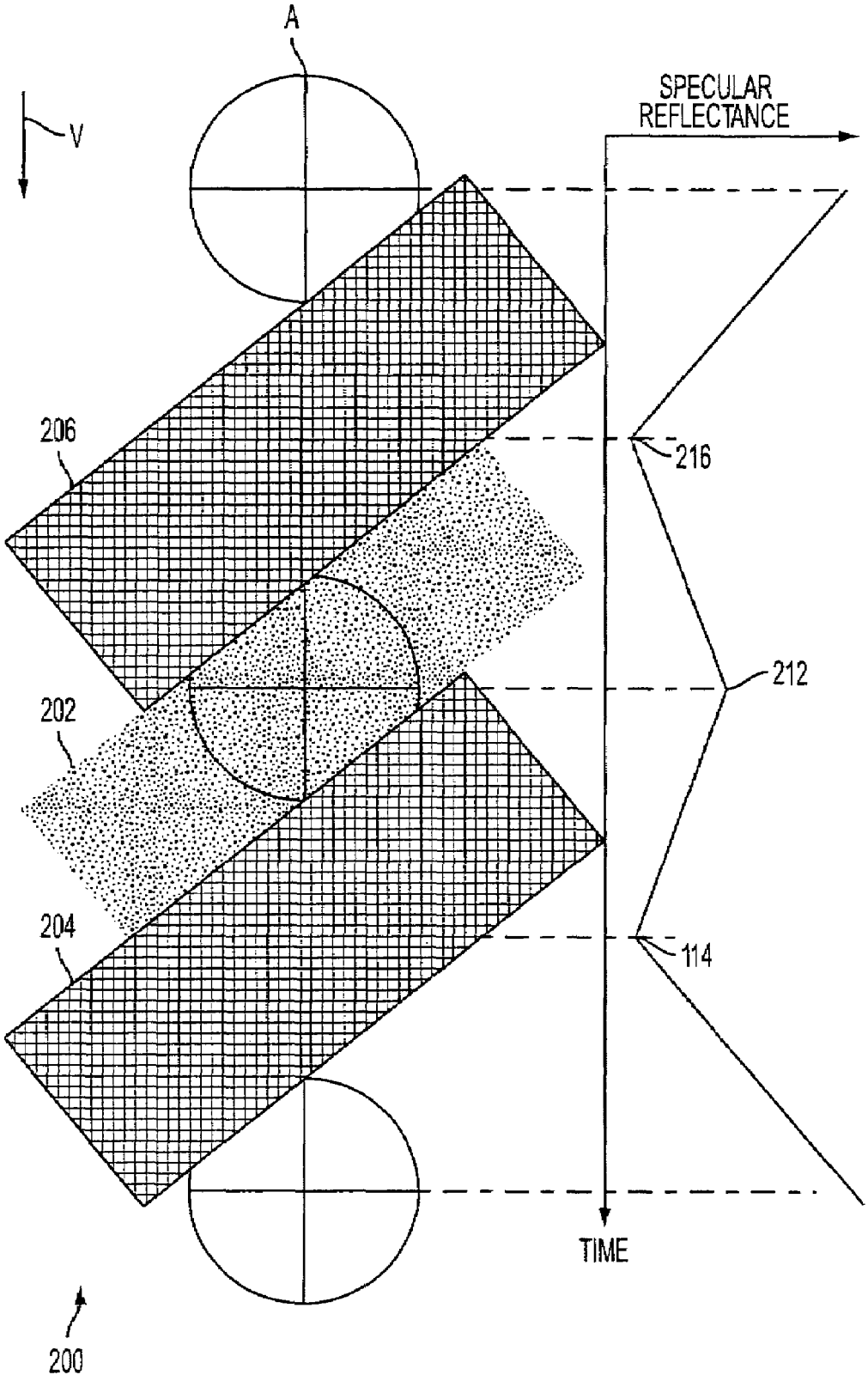
FIGS. 6A, 6B, 6C diagrammatically show a suitable toner pattern for performing the coarse alignment in the cross direction.
Figure 6B:
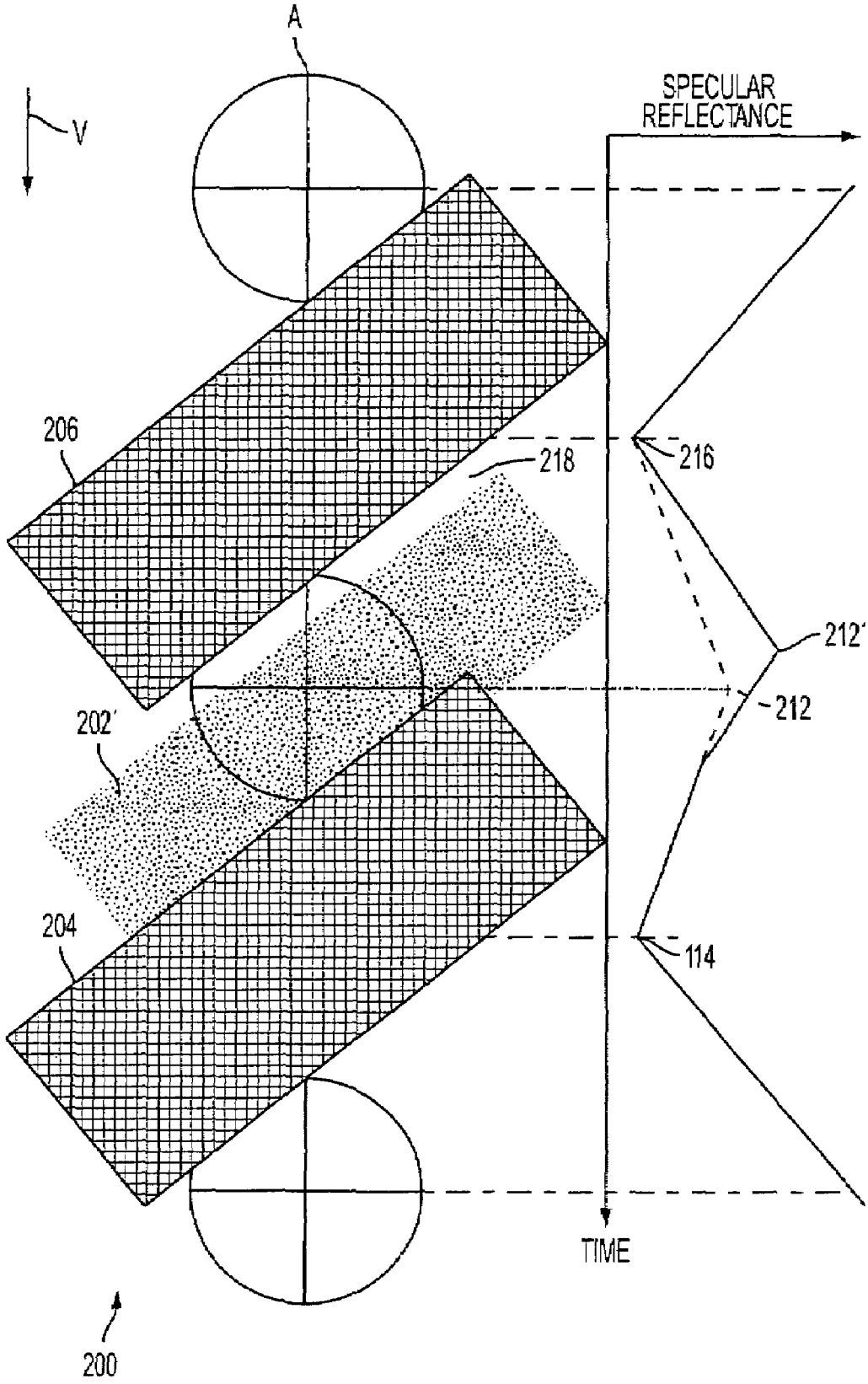
Figure 6C:
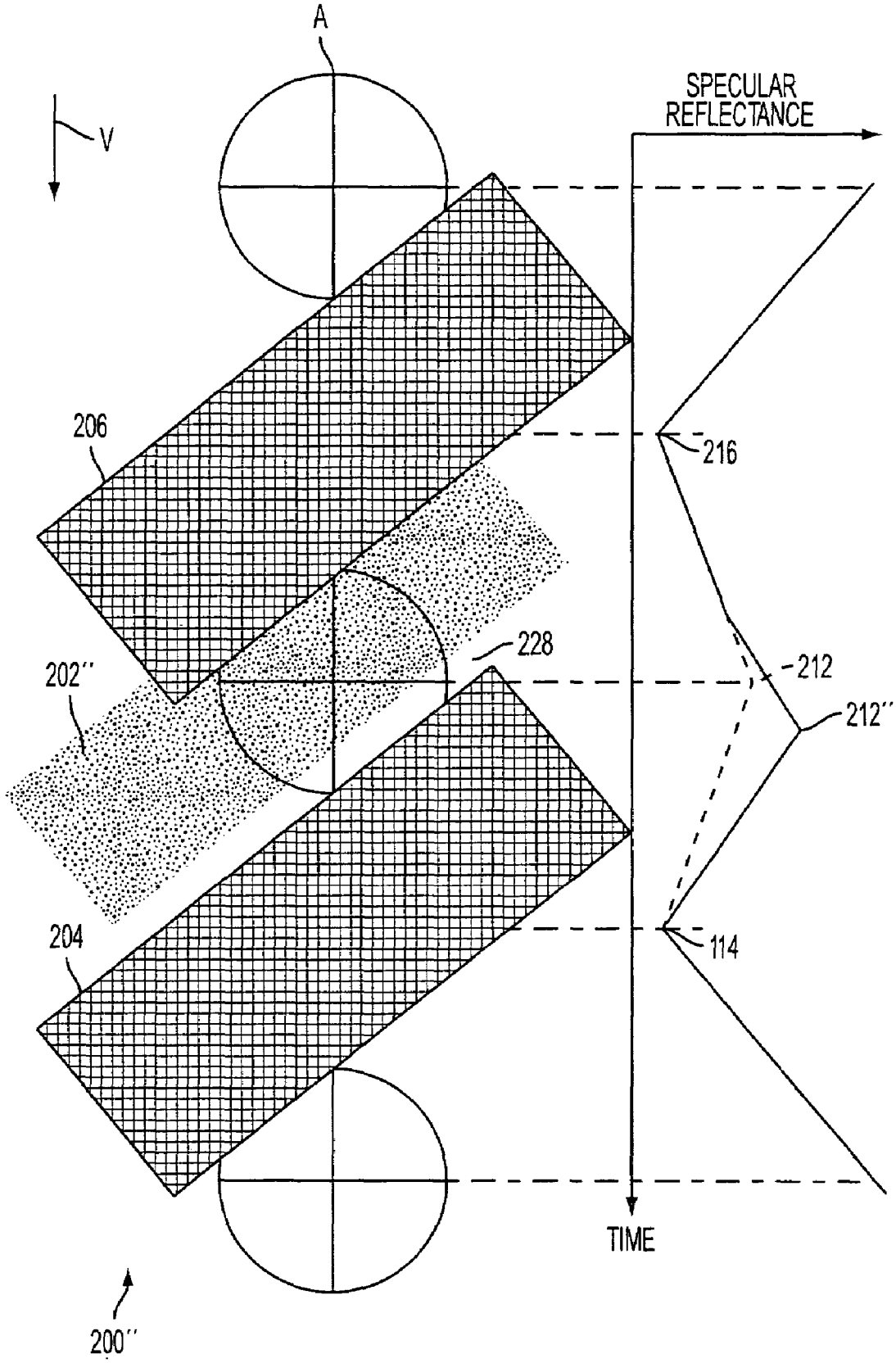

With reference to FIGS. 6A, 6B, and 6C, the coarse cross registration calibration is next described. The approach is similar to the coarse process registration, except that a pattern 200 includes HLC toner region 202 and abutting black toner regions 204, 206 that are tilted to have edge components in both the process and cross directions. Edge components in the process direction provide temporal variation in the reflectance signal as the photoreceptor belt 10 moves in the process direction at the velocity v. Edge components in the cross direction provide sensitivity to misregistration in the cross direction. The cross registration calibration is preferably performed after the process registration calibration is complete, so that any detected misregistration is known to be in the cross direction.

FIG. 6A shows the case in which there is substantially no coarse cross misregistration. In this case, the regions 204, 206 abut the region 202 so that there are no gaps in the test pattern 200. On the right-hand side of FIG. 6A is plotted the specular reflectance as a function of time. Since the belt is moving at the velocity v, the time dimension corresponds to position of the illuminated area A on the belt. Several positions of the perimeter of the illuminated area A are shown superimposed on the pattern 200 in FIG. 6A. When the area A is disposed entirely outside of the test pattern 200, the reflectance signal is at its maximum, assuming that the surface of the photoreceptor belt 10 has a higher reflectance than the toner-covered photoreceptor belt surface. When the illumination area A is mostly or completely within one of the black toner areas 204, 206, the reflectance signal is at its minimum, assuming that the black toner has low reflectance. When the illumination area A is mostly or completely within the HLC toner area 202, the reflectance signal is at an intermediate value, assuming that the HLC toner has a reflectance that is intermediate between that of the black toner and the bare, uncoated surface of the photoreceptor 10. Accordingly, as seen in FIG. 6A the reflectance as a function of time exhibits a maximum value point or interval 212 when the illumination area is centered on the HLC toner area 202, and two minimum value points or intervals 214, 216 when the illumination area is centered on the black toner areas 204, 206, respectively.

FIG. 6B shows a test pattern 200' in which the there is some coarse relative misregistration in the cross direction between the HLC toner area 202' and the abutting black toner areas 204, 206. In FIG. 6B, the cross directional misregistration causes the area targeted for HLC toner coverage to partially overlap the black toner area 204. The portion of the HLC toner area 202' which would have overlapped the black toner 204 does not get developed. Moreover, there is a gap 218 between the black toner region 206 and the HLC toner region 202' due to the cross directional misregistration. In the reflectance pattern plotted at the right of FIG. 6B, the misregistration causes the maximum value point or interval 212 (shown in phantom in FIG. 6B) to be shifted to a new, higher maximum reflectance value point or interval 212'. The maximum 212' is higher than the maximum 212 because of the higher reflectance of the bare region 218. In addition to having a higher maximum reflectance, the maximum reflectance value point or interval 212' is temporally shifted because of the bare region 218.

FIG. 6C shows a test pattern 200" in which the there is some coarse relative misregistration in the cross direction between the HLC toner area 202" and the abutting black toner areas 204, 206. In FIG. 6C, the cross directional misregistration causes the area targeted for HLC toner coverage to partially overlap the black toner area 206, with a gap 228 between the black toner region 204 and the HLC toner region 202" due to the cross directional misregistration. In the reflectance pattern plotted at the right of FIG. 6C, the cross directional misregistration causes the maximum value point or interval 212 (shown in phantom in FIG. 6C) to be shifted to a new, higher maximum reflectance value point or interval 212" that is higher than the maximum 212 and is temporally shifted.

With continuing reference to FIGS. 1, 6A, 6B, and 6C, based on the magnitude and time-shift of the maximum points 212', 212", the coarse cross directional alignment processor 74 makes a suitable coarse cross directional registration correction applied to one or both imaging sub-stations 24, 34. The correction can be based on a table of corrections versus time-shift and/or amplitude shift of the peak 212', 212". Alternatively, the correction can be a selected percentage of the time shift.

With continuing reference to FIGS. 1, 6A, 6B, and 6C, based on the time-shift of the maximum points 212', 212", the coarse cross directional alignment processor 74 makes a suitable coarse registration correction in the cross direction applied to one or both imaging sub-stations 24, 34. The correction can be based on a table of corrections versus time-shift of the peak 212', 212". Alternatively, the correction can be a selected percentage of the time shift. Optionally, the amplitude shift of the peak 212', 212" can be used alone or in conjunction with the magnitude of the time shift to determine the magnitude of the spatial toner misalignment. Advantageously, the direction of asymmetry of the reflectance versus time (for example, compare the reflectance plots of FIGS. 6B and 6C) is indicative of the direction of misregistration, and the overall asymmetry is indicative of the magnitude of misregistration.

Figure 7A:
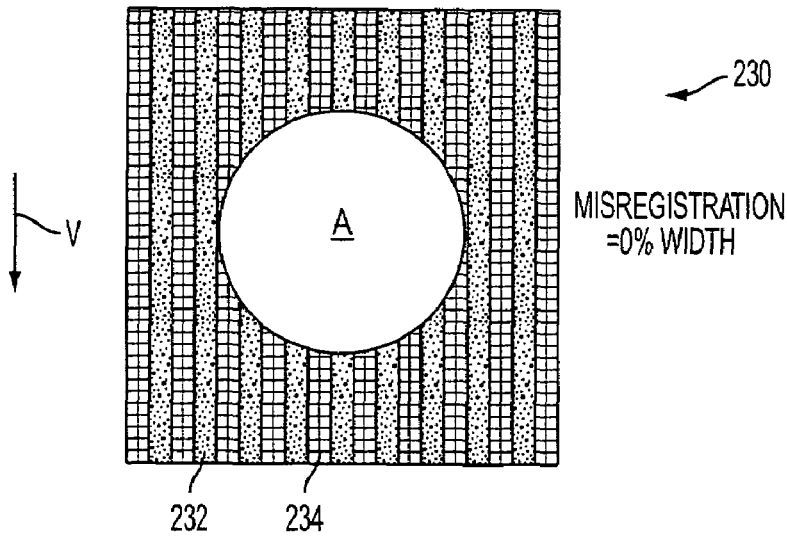
FIGS. 7A, 7B, 7C diagrammatically show a suitable toner pattern for performing the fine alignment in the cross direction.
Figure 7B:
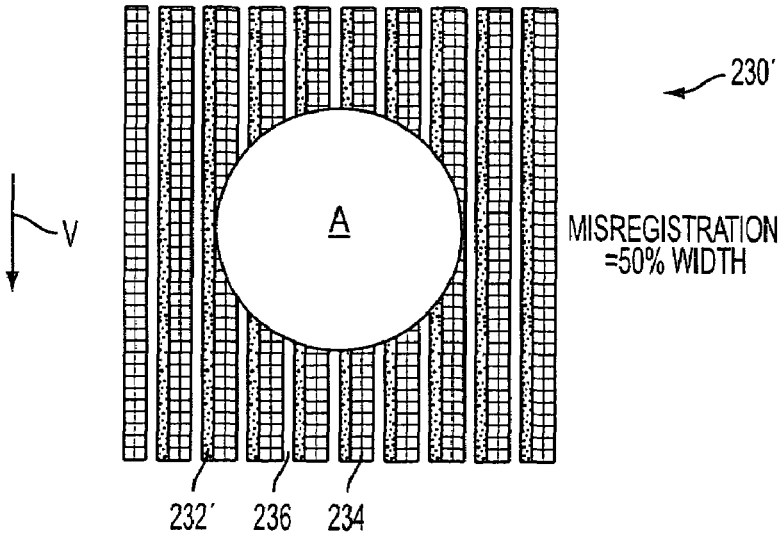
Figure 7C:
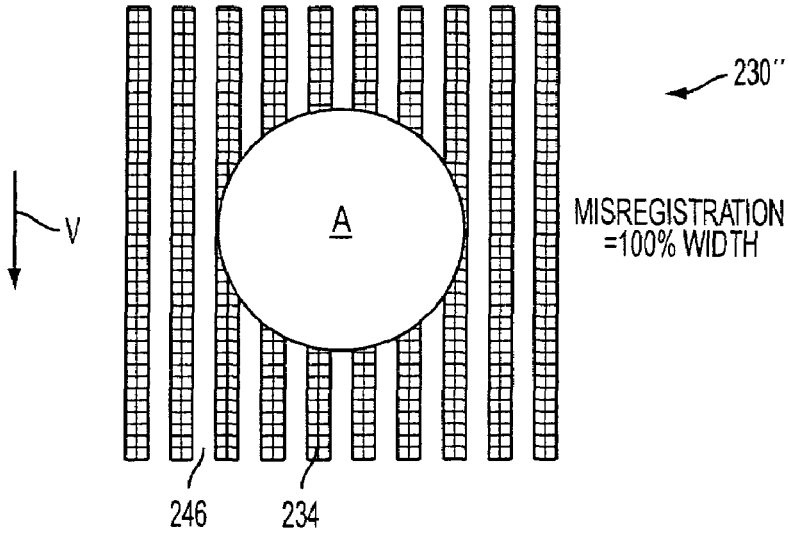

With reference to FIGS. 7A, 7B, and 7C, after the coarse cross directional misregistration is corrected using the test pattern 200, a fine registration adjustment in the cross direction is optionally performed using a test pattern 230. FIG. 7A shows the test pattern 230 which includes interleaved HLC toner regions 232 and black toner regions 234. The regions 232, 234 are substantially longer than the area A (indicated by a white circular region in FIGS. 7A, 7B, and 7C) illuminated by the ETAC sensor 40 in the process direction, that is, parallel with the belt velocity v. Dimensions of the regions 232, 234 in the cross direction that is transverse to the belt velocity v are substantially smaller than the dimension of the illuminated area A in the process direction.

FIG. 7A shows the case in which there is substantially no fine process misregistration. In this case, the regions 232, 234 abut so that there are no gaps in the test pattern 230. FIG. 7B shows a corresponding pattern 230' in which there is a fine process misregistration of about 50% of the width of the regions 232, 234 in the cross direction. In this case, there are gaps 236 of about one-half the width of the regions 232, 234. Since the HLC toner does not develop on top of the previously developed black toner, the regions 232 are replaced by regions 232' that are reduced in width in the cross direction by about 50% versus the registered regions 232. FIG. 7C shows a corresponding pattern 230" in which there is a misregistration of about 100% of the width of the regions 232, 234 in the process direction. In this case, there are gaps 246 of about the width of the regions 232, 234. Since the HLC toner completely overlaps the black regions in this case, there is no HLC toner region in the 100% width misregistration case of FIG. 7C.

The specular reflectance from the pattern 230, 230', 230" as a function of misregistration is qualitatively similar to that plotted in FIG. 5 for the fine coarse registration calibration. For misregistrations greater than 100% or less than −100%, the reflectance becomes periodic, so that it is advantageous to perform the fine cross directional alignment after the coarse cross directional alignment. The fine cross alignment processor 76 performs a fine adjustment of one or both imaging sub-stations 24, 34 based on the specular reflectance of the pattern 230, 230', 230".

In FIGS. 3A, 3B, 3C, and 6A, 6B, and 6C, it will be noted that the specular reflectance versus time plots are relatively sharp, with well-defined cornered transitions. This sharpness will be present if area A is uniformly illuminated within a well-defined perimeter. In some other embodiments, the illumination area is not as uniformly illuminated, producing a less well-defined perimeter of the area A. Nonetheless, the general shape of the reflectance curve, including the extrema 112, 112', 112", 114, 116, 212, 212', 212", 214, 216, will be retained with non-uniform illumination. If the illumination area A in the direction of belt velocity v is smaller than the dimension of the HLC toner region 102, 212 in the direction of belt velocity v, then the maxima 112, 112', 112", 212, 212', 212" will be intervals rather than the illustrated points. If the illumination area A in the direction of belt velocity v is larger than the dimension of the HLC toner region 102, 212 in the direction of belt velocity v, then the maxima 112, 112', 112", 212, 212', 212" will be reduced in amplitude (since some of the black toner regions will fall within the area A even when the area A is centered on the HLC toner region 102, 212). The effect of a non-uniform illumination over the area A by the ETAC sensor 40 on the fine registration calibrations of FIGS.

4A, 4B, 4C, 5, 7A, 7B, and 7C is to modify the amplitudes of the reflectance, but the overall periodic shape of the reflectance versus fine misregistration (such as is plotted in FIG. 5) is retained.

While described with example reference to the xerographic printing system 8 which has two toner development systems 12, 14, the described approaches to toner coverage and relative spatial toner registration measurement and calibration are readily extended to printing systems having more than two toner development systems. For example, in a CMYK color printing system, the cyan, magenta, and yellow toner development systems can be spatially registered respective to the black toner system to effectuate relative spatial registration of all four toner development systems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic printing method comprising:

performing xerographic printing including marking a sequence of sheets using a photoreceptor and multiple toner development systems;

measuring density of toner coverage on the photoreceptor provided by the multiple toner development systems using a toner density sensor; and performing spatial registration of the multiple toner development systems using the toner density sensor, the performing of spatial registration of the multiple toner development systems being interleaved amongst the marking of sheets.

2. The xerographic printing method as set forth in claim 1, wherein the optical toner density sensor includes a light source arranged to illuminate a region of the photoreceptor and a photodetector arranged to detect light from the light source that is specularly reflected from the photoreceptor.

3. The xerographic printing method as set forth in claim 1, wherein the photoreceptor is a moving photoreceptor, and the performing of spatial registration comprises:

forming a coarse pattern of toner-coated regions on the moving photoreceptor using two or more toner development systems of the multiple toner development systems, a dimension of the toner-coated regions of the coarse pattern in a direction of photoreceptor movement being comparable with a dimension of a sensing area of the toner density sensor in the direction of photoreceptor movement;

measuring the toner density sensor output as the photoreceptor moves the coarse pattern of toner-coated regions through the sensing area to produce a time-dependent toner density sensor signal; and determining a coarse misregistration of the two or more toner development systems based on the time-dependent toner density sensor signal.

4. The xerographic printing method as set forth in claim 3, wherein the performing of spatial registration further comprises:

correcting the determined coarse misregistration by adjusting an imaging station of at least one of the two or more toner development systems.

5. The xerographic printing method as set forth in claim 4, wherein the performing of spatial registration further comprises:

forming a fine pattern of toner-coated regions on the moving photoreceptor using the two or more toner development systems, a dimension of the toner-coated regions of the fine pattern in a selected direction being substantially smaller than the dimension of the sensing area of the toner density sensor in the selected direction;

measuring the toner density sensor output with the fine pattern of toner-coated regions disposed in the sensing area to produce a substantially constant toner density sensor signal; and determining a fine mis-registration of the two or more toner development systems based on the substantially constant toner density sensor signal.

6. The xerographic printing method as set forth in claim 3, wherein the coarse pattern of toner-coated regions is non-varying in a direction transverse to the direction of photoreceptor movement, and the determined coarse misregistration is in the direction of photoreceptor movement.

7. The xerographic printing method as set forth in claim 6, further comprising:

repeating the forming a coarse pattern with a second coarse pattern of toner-coated regions that varies in a direction non-parallel with the direction of photoreceptor movement; and repeating the measuring and determining respective to the second coarse pattern to determine coarse misregistration is in a direction transverse to the direction of photoreceptor movement.

8. The xerographic printing method as set forth in claim 3, wherein the coarse pattern of toner-coated regions varies in a direction non-parallel with the direction of photoreceptor movement, and the determined coarse misregistration is in a direction transverse to the direction of photoreceptor movement.

9. The xerographic printing method as set forth in claim 1, wherein the performing of spatial registration comprises:

forming a pattern of toner-coated regions on the moving photoreceptor using the two or more toner development systems, a dimension of the toner-coated regions in a selected direction being substantially smaller than the dimension of the sensing area of the toner density sensor in the selected direction;

measuring the toner density sensor output with the fine pattern of toner-coated regions disposed in the sensing area to produce a substantially constant toner density sensor signal; and determining a mis-registration of the two or more toner development systems based on the substantially constant toner density sensor signal.

10. The xerographic printing method as set forth in claim 9, wherein the forming of the pattern comprises:

forming a first pattern of toner-coated regions having alternating toner coated regions along a direction of photoreceptor movement; and forming a second pattern of toner-coated regions having alternating toner coated regions along a direction non-parallel with the direction of photoreceptor movement;

the first pattern being measured to determine misregistration of the two or more toner development systems along the direction of photoreceptor movement; and the second pattern being measured to determine misregistration of the two or more toner development systems along a direction transverse to the direction of photoreceptor movement.

11. A xerographic printing system comprising:

a moving photoreceptor;

multiple toner development systems arranged to selectively dispose regions of toner on the moving photoreceptor;

a toner density sensor arranged to measure toner density on the moving photoreceptor over a sensor area, the toner density sensor including an optical source and a focusing optic that focuses the optical source such that the sensor area is irradiated by the optical source with a substantially uniform intensity;

a toner coverage monitor operatively connected with the toner density sensor that monitors toner coverage based on measurements by the toner density sensor of toner coverage calibration regions disposed on the moving photoreceptor by the multiple toner development systems; and a spatial registration monitor also operatively connected with the toner density sensor that monitors spatial registration of the multiple toner development systems based on measurements by the toner density sensor of spatial registration calibration regions disposed on the moving photoreceptor by the multiple toner development systems.

12. The xerographic system as set forth in claim 11, wherein the spatial registration calibration regions includes alternating regions each large enough to substantially fill the sensor area of the toner density sensor, the toner-coated regions alternating along a direction of photoreceptor movement, the spatial registration monitor performing a method comprising:

causing the toner density sensor to measure a time-varying signal as the alternating toner-coated regions pass across the sensor area; and determining misregistration along a selected direction based on the time-varying signal.

13. The xerographic printing system as set forth in claim 12, wherein the determining of misregistration comprises:

determining a direction of the misregistration based on an asymmetry of the time-varying signal.

14. The xerographic system as set forth in claim 11, wherein the spatial registration calibration regions includes coarse alternating toner regions which are comparable with the sensor area and fine alternating toner regions which have a dimension substantially smaller than the sensor area, the spatial registration monitor performing a method comprising:

determining a coarse misregistration based on measurements of the coarse alternating toner regions by the toner density sensor;

correcting the coarse misregistration; and subsequent to correcting the coarse misregistration, determining a fine misregistration based on measurements of the fine alternating toner regions by the toner density sensor.

15. A xerographic system comprising:

a moving photoreceptor;

multiple toner development systems arranged to selectively dispose regions of toner on the moving photoreceptor;

a toner density sensor arranged to measure toner density on the moving photoreceptor over a sensor area;

a toner coverage monitor operatively connected with the toner density sensor that monitors toner coverage based on measurements by the toner density sensor of toner coverage calibration regions disposed on the moving photoreceptor by the multiple toner development systems; and a spatial registration monitor also operatively connected with the toner density sensor that monitors spatial registration of the multiple toner development systems based on measurements by the toner density sensor of spatial registration calibration regions disposed on the moving photoreceptor by the multiple toner development systems, the spatial registration calibration regions including first alternating toner regions that alternate along the direction of photoreceptor movement and second alternating toner regions that alternate along a direction non-parallel to the direction of photoreceptor movement, the spatial registration monitor performing a method comprising:

determining a misregistration in the direction of photoreceptor movement based on measurements of the first alternating toner regions by the toner density sensor, correcting the misregistration in the direction of photoreceptor movement, subsequent to correcting the misregistration in the direction of photoreceptor movement, determining a misregistration transverse to the direction of photoreceptor movement based on measurements of the second alternating toner regions by the toner density sensor, and correcting the misregistration transverse to the direction of photoreceptor movement.

16. The xerographic printing system as set forth in claim 15, wherein the toner density sensor comprises:

an optical source irradiating the moving photoreceptor over the sensor area; and an optical sensor sensing specular reflection of the irradiation.

* * * * *